7/9/85 XR 4,528,229

United States Patent [19]

Gottlieb

[11] Patent Number: 4,528,229

[45] Date of Patent: Jul. 9, 1985

[54] CAMOUFLAGE MATERIAL FOR USE AS PROTECTION AGAINST RADAR OBSERVATION

[76] Inventor: Willi Gottlieb, No. 15 Avannarliit, 3900 Nuuk, Greenland

[21] Appl. No.: 586,263

[22] Filed: Mar. 5, 1984

[30] Foreign Application Priority Data

Mar. 14, 1983 [DK] Denmark ..... 1183/83

[51] Int. Cl.[3] ..... F41H 3/00

[52] U.S. Cl. ..... 428/85; 428/95; 428/96; 428/919

[58] Field of Search ..... 428/919, 85, 95, 96, 428/17

[56] References Cited

U.S. PATENT DOCUMENTS 1,939,846 12/1933 Fenton .
3,069,796 12/1962 Ruter .
3,187,331 6/1965 Beller .
3,332,828 7/1967 Faria et al. .
3,599,210 8/1971 Stander .
3,733,606 5/1973 Johansson .
4,001,827 1/1977 Wallin et al. .
4,034,375 7/1977 Wallin .
4,287,243 9/1981 Nielsen ..... 428/919

FOREIGN PATENT DOCUMENTS 1404121 8/1975 United Kingdom .

*Primary Examiner*—Marion E. McCamish
*Attorney, Agent, or Firm*—Stevens, Davis, Miller & Mosher

[57] ABSTRACT

A camouflage material, preferably in the form of a camouflage mat, for use as protection against radar observation, comprises a support layer (1) with filament or threadlike pieces, which affect radar waves, for example carbon or metal thread. With a view to optimal protection against radar observation, these substances are applied to the support layer (1) with arbitrarily mutual directions and positions and with random spatial orientations and distribution.

9 Claims, 1 Drawing Figure

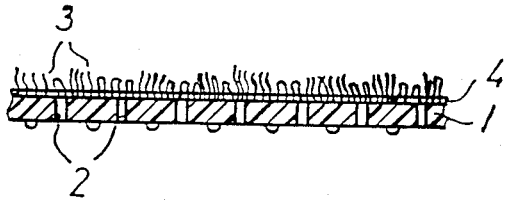
3
4
1
2

CAMOUFLAGE MATERIAL FOR USE AS PROTECTION AGAINST RADAR OBSERVATION

BACKGROUND AND FIELD OF THE INVENTION

The present invention relates to a camouflage material for multi-spectral camouflage including protection from radar observation, comprising a layer-shaped backing material with a pile of textile or synthetic fibres or loops of mainly unequal lengths and lying in different directions, said fibres or loops being fixed to the backing material for example by weaving, embedding or tufting, whereby provision is made of filament or threadlike pieces that affect radar waves, for example carbon or metal threads or metal coated synthetic fibres.

To camouflage objects or constructions against radar observation, for example from the air, it is known that materials can be used which absorb part of the radar signals - and thereby hinder or at least reduce reflections of these signals from the camouflaged object-, or materials which reflect incident radar signals in different directions so that an observer is deceived, or eventually a combination of absorptive or reducing materials and reflecting or scattering materials is used.

For example, from U.S. Pat. No. 3,733,606, a camouflage material is known in which a foil, that constitutes part of a multi-layered material, forms a conducting thin layer in the form of a metallic grid of threads or metallized fibres of synthetic material. Such threads or fibres, which can have a diameter of about 8 microns, or slightly more, and lengths of 7–16 cm, can be irregularly distributed in a layer of synthetic material or needle felt, that can be combined with one or more other layers which are dyed or treated to achieve optical camouflage, camouflage in the infrared spectrum and eventually also give a reduction of radar signal reflections.

In this way a certain camouflage effect is achieved, which can be improved if the material is provided with slits and stretched so that after stretching a so-called three-dimensional structure results which also improves the radar camouflage effect, partly due to scattering of the radar signals, partly due to an increase in radar energy losses by ohmic and dielectric losses.

This known camouflage material and in particular its single layers has little thickness, e.g. about 0.5 mm in all, and the aforementioned metal threads are substantially all lying in one and the same plane, which results in a severe limitation with respect to scattering of the incoming and reflected radar signals. A not inconsiderable amount of the radiation can be assumed to be reflected towards the radar receiver, which facilitates a certain usage of the radar return.

From U.S. Pat. No. 3,599,210 a radar wave absorbing coating is known, in the form of a lossy dielectric resin binder within which there is embedded randomly distributed conducting fibres, of a length corresponding to one half of the wavelength of the expected radar radiation. These fibres function as resonantly tuned dipoles, when the coating is irradiated with radar signals having the wavelength, to which said fibres are tuned, and an electromagnetic energy loss occurs in the lossy binder.

This known coating, that only protects against radar observation, but hardly offers any considerable protection against visual observation, i.e. does not result in a multi-spectral camouflage, is obviously only suited—and intended—to be used for the protection of aircrafts, missiles and the like against radar observation, whereas it is not suited to be used for the protection of fixed installations and objects or for use in terrain, partly because it does not offer any multispectral camouflage, partly due to its construction which has low mechanical strength and for example does not tolerate traffic, particularly vehicular traffic. Furthermore this known coating has a drawback in that the embedded fibres always hold one and the same orientation, and they cannot be supplemented or replaced with fibres of a different length if the radar frequency should be different from the one expected. In such case there could arise an undesirable and consistent reflection pattern.

From U.S. Pat. No. 4,287,243 and corresponding Danish Patent Specification No. 144954 a camouflage material is known of the previously described type, with material that affects radar waves, consisting of radar wave absorbing fibres or carbon particles and/or locally embedded metal particles or a metal net reflecting radar waves such that a decoy effect is produced. This known camouflage material exhibits by way of its pile construction a considerable mechanical strength and an effective multi-spectral camouflage effect; but a more diffuse and varied scattering and a stronger attenuation of radar waves is desirable in many cases.

The present invention it is intended therefore to produce a similar robustly constructed and universally applicable camouflage material, which by simple means affords not only an effective multi-spectral camouflage, also in the themal, the optical and the near infrared range, but, in addition, also a much improved protection against radar observation.

NOVEL FEATURES OF THE INVENTION

The material of the present invention differs from the prior art in that the filament or thread like pieces affecting radar waves are applied to the camouflage materials unshielded free upper surface with arbitrarily mutual directions and positions and with random spatial orientations and distribution.

Material with said design, which like the material known from U.S. Pat. No. 4,287,243 offers great mechanical strength as well as an effective multi-spectral camouflage effect, but in which the filament or threadlike metallic objects extend in all possible directions and planes, will reflect incoming radar signals in practically every conceivable direction both within and outside the material and thereby also attenuate or absorb certain parts of the signal, and thus achieve an optimal camouflage against radar observation.

The portion or the components of a radar signal, which by the camouflage material of the present invention is/are reflected towards the radar receiver, will be minimal and significantly lower than that reflected to the receiver by known universally employed camouflage material; and, due to the strong scattering of the radar signals owing to the great number of reflections from the filament or threadlike metal elements also the achieved level of absorption/attenuation of radar signals in the said material will lie significantly higher than the signal energy losses achieved by known camouflage material. Possibly the metallic reflecting elements may be mixed with absorbing elements or attenuating elements such as carbon fibres.

It is a further advantage of the camouflage material, or a camouflage mat, of the present invention, that owing to the characteristic applying of the elements that affect radar waves—such elements are preferably not of equal length—in many cases a continuous but random change of their relative orientations occurs due to climatic variations such as a change of wind direction or due to traffic. In addition the users of the camouflage material may themselves bring about such changes by mechanical manipulation of the material, e.g. by means of a broom, or by replacing or supplementing of the existing fibres by other fibres.

A more or less constant—albeit weak—reflection pattern is thereby avoided.

BRIEF DESCRIPTION OF THE DRAWING

The single FIGURE of drawing is a transverse sectional view of a camouflage material according to the present invention.

DETAILED DESCRIPTION OF PREFERRED EMBODIMENTS

A possible and suitable embodiment of the invention is shown schematically in the attached FIGURE, which depicts a camouflage mat of a type similar to that which is known from U.S. Pat. No. 4,287,243.

This mat comprises a support layer 1, that for example can be of rubber or foam plastic and which can be heat insulating, and which preferably may have perforations 2, so that liquids such as rainwater can penetrate the layer if so desired.

The side of the support layer 1, which in use faces away from the camouflaged object or construction, carries a diffusely reflecting material that for example may be constituted by a pile of yarn or synthetic fibres of varying lengths, e.g. in the range of 1.5 to 4 cm. These textile or synthetic fibres 3, can be cast in layer 1 at their ends or be affixed to it by weaving or tufting for example into a backing material 4, which can be of synthetic material and which is fixed to layer 1. With tufting, loops are formed on the outside of the mat, and some of these loops or all of them can eventually be cut.

This mat, that here is only described in such detail as is necessary for understanding the present invention, gives an effective protection against optical detection, and this protection can be supplemented with some protection from radar if in layer 1 reflection attenuating material is embedded such as radar absorbing fibres or carbon particles. Likewise there preferably could be locally embedded metal particles or metal nets, which increase radar reflections so that a decoy effect for observers and sensors or detectors is produced.

If embedded in layer 1, in the described manner, or eventually applied to the surface of layer 1, the radar reflecting fibres will, however, lie substantially in one plane, and although they would produce some scattering of the reflected radar waves in a similar way as the camouflage means known from U.S. Pat. No. 3,733,606, a not insignificant amount of the incident radiation could be reflected back towards the radar receiver and hence be detected.

To make such detection more difficult it is proposed, according to the present invention, that, thread or filament-like metallic or metallized objects, especially metal threads or metal coated synthetic fibres—preferably together with absorbing objects such as carbon fibres—, be applied to and fastened to support layer 1 with quite arbitrary and different mutual directions and positions, and with quite random spatial orientations and distribution.

Such a radar protective layer can for example be realized by addition, for instance by spraying, under differing angles of threadlike objects which affect radar waves onto the surface of a support layer, which has beforehand been made sticky or been covered by a suitably thick layer of a sticky fluid which later hardens to a plastic mass, said fluid serving as a binder, and eventually in addition under the influence of a variable magnetic and/or electric field which causes the threadlike objects to impinge and be fixed to the support layer or the fluid layer at random and widely differing angles thereto.

If the basis is a camouflage mat as described above and as is known from U.S. Pat. No. 4,287,243 an optimum protection from radar observation can also be achieved for example when metal thread pieces or metal coated synthetic thread pieces, which have suitable diameters and are cut to suitable but preferably different lengths in accordance with the radar frequencies against which a camouflage effect is sought, are strewn out over such an existing mat and eventually fixed to its pile which supports the thread pieces by way of a binder for example from a spray cylinder. The lengths of the single thread pieces are not necessarily adapted to a particular frequency and some of the threads may be in contact with each other.

It is also possible before weaving or tufting of the pile to weave in thread pieces affecting radar waves into the basis material, for example yarns or synthetic fibres, from which the pile is formed. As the yarn or fibre ends or loops, that make up the finished pile, extend in all possible directions and lie at all possible angles between horizontal and vertical to the support layers' surface, then the thread pieces that affect radar, i.e. by reflecting and absorbing, will also adopt all possible directions and make all possible angles in relation to each other and in relation to the support layer, such that the radar wave reflection in such a layer will be correspondingly spread and multidirectional, for example from metal threads to other metal threads or from metal threads to carbon threads, and the loss of radar energy due to attenuation and absorption under these internal reflections in the layer will be optimal, and concurrently, thereby will reflection towards a radar detector be minimal and hardly detectable—at least not unambiguously detectable.

An effective camouflage in the thermal, the optical and the near infrared ranges is thus supplemented with an effective camouflage in the radar range, and a possibility for total camouflage is thereby created in a simple constructed robust and invulnerable material which not only can stand the rough treatment of rapid deployment, but also traffic.

In the embodiment illustrated in the FIGURE there are a number of spacers, for example spacing ribs, indicated on the back of the support layer, which in use lie against the camouflaged object or construction. In this manner extra heat insulation is achieved, and liquids such as rainwater that may have soaked through the support layer can be drained off. Further these ribs can increase the inherent stiffness of a camouflage mat in accordance with the invention and thereby its contour hiding effect.

I claim:

1. A camouflage material for use as multi-spectral camouflage including protection against radar observation, comprising a layered backing material with a pile of textile or synthetic fibres or loops preferably of unequal lengths and extending in different directions, said fibres or loops being fixed to the support backing material; filament or threadlike pieces, which affect radar waves applied to the camouflage material's unshielded free upper surface with arbitrarily mutual directions and positions and with random spatial orientations and distribution.

2. A camouflage material as claimed in claim 1, in which the filament or threadlike pieces, that affect radar waves, are strewn randomly over the pile and fixed to it with a binder such as glue.

3. A camouflage material as claimed in claim 1, in which filament or threadlike pieces, that affect radar waves, are spun into the material, such as yarn or synthetic fibre, which constitutes the pile.

4. A camouflage material as claimed in claim 1 in which the fibres or loops are fixed to the backing material by weaving, embedding or tufting.

5. A camouflage material as claimed in claim 1 in which the filament or threadlike pieces which affect radar waves is carbon or metal threads or metal coated synthetic fibres.

6. In a multi-spectral camouflage mat having a backing material with pile fibres projecting from the outer surface of said mat the improvement comprising:

said pile comprising textile or synthetic fibres or loops of unequal length projecting from said backing material in randomly different directions, and a plurality of filaments or threadlike pieces of a material which affects radar waves applied to the pile in random spatial orientation and direction.

7. The mat of claim 6 in which the pile is secured to the backing material by weaving, embedding or tufting.

8. The mat of claim 6 in which the material which affects radar waves is carbon or metal threads or metal coated synthetic fibres.

9. The mat of claim 6 in which the material which affects radar waves is spun into the material of the pile.

* * * * *